US008371517B2

(12) United States Patent
Kwok et al.

(10) Patent No.: US 8,371,517 B2
(45) Date of Patent: Feb. 12, 2013

(54) POWDER GUN DEFLECTOR

(75) Inventors: Kui-Chiu Kwok, Gurnee, IL (US); John F. Schaupp, Sylvania, OH (US)

(73) Assignee: Illinois Tool Works Inc., Glenview, IL (US)

( * ) Notice: Subject to any disclaimer, the term of this patent is extended or adjusted under 35 U.S.C. 154(b) by 307 days.

(21) Appl. No.: 11/771,541

(22) Filed: Jun. 29, 2007

(65) Prior Publication Data

US 2009/0001199 A1 Jan. 1, 2009

(51) Int. Cl.

| | |
|---|---|
| ***B05B 5/00*** | (2006.01) |
| ***F23D 11/32*** | (2006.01) |
| ***B05B 1/26*** | (2006.01) |
| ***B05B 1/28*** | (2006.01) |

(52) U.S. Cl. ..... 239/698; 239/290; 239/296; 239/518

(58) Field of Classification Search ..... 239/697–698, 239/690, 690.1, 290–291, 294–297, 299, 239/518, 520, 524

See application file for complete search history.

(56) References Cited

U.S. PATENT DOCUMENTS

| | | | |
|---|---|---|---|
| 2,759,763 | A | 8/1956 | Juvinall |
| 2,955,565 | A | 10/1960 | Schotland |
| 3,102,062 | A | 8/1963 | Graham et al. |
| 3,233,655 | A | 2/1966 | Graham |
| 3,536,514 | A | 10/1970 | Faye et al. |
| 3,575,344 | A | 4/1971 | Angelico |
| 3,578,997 | A | 5/1971 | Felici |
| 3,589,607 | A | 6/1971 | Wolf et al. |
| 3,610,528 | A | 10/1971 | Felici |
| 3,684,174 | A | 8/1972 | Bein |
| 3,698,636 | A | 10/1972 | Szasz |
| 3,744,678 | A | 7/1973 | Beres et al. |
| 3,843,054 | A | 10/1974 | Kendall et al. |
| 3,865,283 | A | 2/1975 | Hayes |
| 3,913,523 | A | 10/1975 | Probst et al. |
| 3,964,683 | A | 6/1976 | Gimple |
| 4,037,561 | A | 7/1977 | LaFare et al. |
| 4,039,145 | A | 8/1977 | Felici et al. |
| 4,066,041 | A | 1/1978 | Buschor et al. |

(Continued)

FOREIGN PATENT DOCUMENTS

| | | |
|---|---|---|
| DE | 32 42 362 A1 | 5/1984 |
| FR | 1 274 814 | 11/1960 |

(Continued)

OTHER PUBLICATIONS

International Search Report from PCT/US2008/065616 dated Sep. 1, 2008.

*Primary Examiner* — Len Tran
*Assistant Examiner* — Justin Jonaitis
(74) *Attorney, Agent, or Firm* — Barnes & Thornburg LLP

(57) ABSTRACT

A system for dispensing pulverulent coating material comprises a source of pulverulent coating material, a source of compressed gas, a device for movably supporting a nozzle, the nozzle coupled to the source of pulverulent material and providing an opening through which the pulverulent material is dispensed, a deflector supported by the device and spaced from the opening to aid in shaping a cloud of dispensed coating material, and a source of high-magnitude electrostatic potential coupled to impart electrostatic potential to the dispensed pulverulent material. The deflector includes at least one first passageway extending with a radial component of the deflector and communicating with the source of compressed gas to direct gas with a radial component into the cloud of dispensed coating material.

2 Claims, 11 Drawing Sheets

U.S. PATENT DOCUMENTS

| | | | | |
|---|---|---|---|---|
| 4,114,564 | A | | 9/1978 | Probst |
| 4,135,667 | A | | 1/1979 | Benedek et al. |
| 4,169,560 | A | | 10/1979 | Vohringer |
| 4,171,100 | A | | 10/1979 | Benedek et al. |
| 4,214,708 | A | | 7/1980 | Lacchia |
| 4,215,818 | A | | 8/1980 | Hopkinson |
| 4,216,915 | A | | 8/1980 | Hengartner et al. |
| 4,270,486 | A | | 6/1981 | Leverenz |
| 4,323,197 | A | | 4/1982 | Morishita et al. |
| 4,350,304 | A | | 9/1982 | Sugiyama et al. |
| 4,360,155 | A | | 11/1982 | Hubbell et al. |
| 4,380,320 | A | * | 4/1983 | Hollstein et al. ..... 239/697 |
| 4,381,079 | A | | 4/1983 | Allen |
| 4,402,991 | A | | 9/1983 | Meisner |
| 4,422,577 | A | | 12/1983 | Arnold et al. |
| RE31,590 | E | | 5/1984 | Mitsui |
| 4,447,008 | A | | 5/1984 | Allen |
| 4,450,785 | A | | 5/1984 | Meisner |
| 4,505,430 | A | | 3/1985 | Rodgers et al. |
| RE31,867 | E | * | 4/1985 | Kennon ..... 239/3 |
| 4,518,119 | A | | 5/1985 | Vetter |
| 4,520,754 | A | | 6/1985 | Gange et al. |
| 4,580,727 | A | | 4/1986 | Moos |
| 4,598,870 | A | | 7/1986 | Schloz |
| 4,684,064 | A | | 8/1987 | Kwok |
| 4,685,620 | A | | 8/1987 | Law et al. |
| 4,706,890 | A | | 11/1987 | Talacko |
| 4,726,521 | A | | 2/1988 | Simm et al. |
| 4,779,805 | A | | 10/1988 | Jackson et al. |
| 4,785,995 | A | | 11/1988 | Yamane et al. |
| 4,788,933 | A | | 12/1988 | Buschor |
| 4,798,340 | A | | 1/1989 | Vohringer et al. |
| 4,802,625 | A | | 2/1989 | Buschor |
| 4,825,807 | A | | 5/1989 | Nakamura et al. |
| 4,834,589 | A | | 5/1989 | Dietrich |
| 4,879,137 | A | | 11/1989 | Behr et al. |
| 4,890,190 | A | | 12/1989 | Hemming |
| 4,893,737 | A | | 1/1990 | Borjesson |
| 4,896,384 | A | | 1/1990 | Dijkhuizen |
| 4,921,172 | A | | 5/1990 | Belmain et al. |
| 4,927,081 | A | | 5/1990 | Kwok et al. |
| 5,240,185 | A | | 8/1993 | Kaiju et al. |
| 5,323,547 | A | | 6/1994 | Kaiju et al. |
| 5,335,828 | A | | 8/1994 | Kaiju et al. |
| 5,341,989 | A | * | 8/1994 | Fulkerson et al. ..... 239/3 |
| 5,353,995 | A | | 10/1994 | Chabert |
| 5,358,182 | A | | 10/1994 | Cappeau et al. |
| 5,433,387 | A | | 7/1995 | Howe et al. |
| 5,683,976 | A | | 11/1997 | Colurciello, Jr. et al. |
| 5,720,436 | A | | 2/1998 | Buschor |
| 5,768,800 | A | | 6/1998 | Merritt et al. |
| 5,820,941 | A | * | 10/1998 | Felton et al. ..... 427/476 |
| 5,853,126 | A | * | 12/1998 | Alexander ..... 239/223 |
| 6,144,570 | A | | 11/2000 | Hughey |
| 6,328,224 | B1 | * | 12/2001 | Alexander ..... 239/223 |
| 6,793,150 | B2 | | 9/2004 | Schaupp et al. |
| 6,817,553 | B2 | * | 11/2004 | Steur ..... 239/690 |
| 6,889,921 | B2 | | 5/2005 | Schaupp |
| 7,128,277 | B2 | | 10/2006 | Schaupp |
| 2003/0197078 | A1 | * | 10/2003 | Mauchle et al. ..... 239/690.1 |
| 2005/0001061 | A1 | * | 1/2005 | Mauchle et al. ..... 239/423 |

FOREIGN PATENT DOCUMENTS

| | | |
|---|---|---|
| GB | 1 209 653 | 10/1970 |
| JP | 52-145445 | 12/1977 |
| JP | 52-145448 | 12/1977 |
| JP | 58-124560 | 7/1983 |
| JP | 60-94166 | 5/1985 |
| JP | 60-151554 | 10/1985 |
| JP | 62-140660 | 6/1987 |
| JP | 63-116776 | 5/1988 |
| JP | 1-315361 | 12/1989 |
| JP | 3-169361 | 7/1991 |
| JP | 3-221166 | 9/1991 |
| WO | 2005/035138 A1 | 4/2005 |

* cited by examiner

POWDER GUN DEFLECTOR

FIELD OF THE INVENTION

This application relates to dispensing devices. It is disclosed in the context of dispensing devices (hereinafter sometimes guns) for dispensing pulverulent coating materials (hereinafter sometimes powders) onto articles (hereinafter sometimes targets) to be coated by such powders. However, it is believed to be useful in other applications as well.

BACKGROUND OF THE INVENTION

Several types of dispensing devices for dispensing coating materials such as liquid coating materials (hereinafter sometimes paints), powders and the like are known. There are, for example, the devices illustrated and described in U.S. Pat. Nos. 3,536,514; 3,575,344; 3,698,636; 3,843,054; 3,913,523; 3,964,683; 4,037,561; 4,039,145; 4,114,564; 4,135,667; 4,169,560; 4,216,915; 4,270,486; 4,360,155; 4,380,320; 4,381,079; 4,447,008; 4,450,785; Re. 31,867; 4,520,754; 4,580,727; 4,598,870; 4,685,620; 4,788,933; 4,798,340; 4,802,625; 4,825,807; 4,834,589; 4,893,737; 4,921,172; 5,353,995; 5,358,182; 5,433,387; 5,720,436; 5,768,800; 5,853,126; 6,328,224; 6,793,150; 6,889,921; and, 7,128,277. There are also the devices illustrated and described in U.S. Pat. Nos. 2,759,763; 2,955,565; 3,102,062; 3,233,655; 3,578,997; 3,589,607; 3,610,528; 3,684,174; 3,744,678; 3,865,283; 4,066,041; 4,171,100; 4,214,708; 4,215,818; 4,323,197; 4,350,304; 4,402,991; 4,422,577; Re. 31,590; 4,505,430; 4,518,119; 4,684,064; 4,726,521; 4,779,805; 4,785,995; 4,879,137; 4,890,190; 4,896,384; 4,927,081; 5,683,976; and, 6,144,570; British Patent Specification 1,209,653; Japanese published patent applications: 62-140,660; 1-315,361; 3-169,361; 3-221,166; 60-151,554; 60-94,166; 63-116,776; 58-124,560; 52-145,445; and 52-145,448; and, French patent 1,274,814. There are also the devices illustrated and described in "Aerobell™ Powder Applicator ITW Automatic Division," and, "Aerobell™ & Aerobell Plus™ Rotary Atomizer, DeVilbiss Ransburg Industrial Liquid Systems." The disclosures of these references are hereby incorporated herein by reference. This listing is not intended to be a representation that a complete search of all relevant art has been made, or that no more pertinent art than that listed exists, or that the listed art is material to patentability. Nor should any such representation be inferred.

DISCLOSURE OF THE INVENTION

According to an aspect of the invention, a system for dispensing pulverulent coating material consists essentially of a source of pulverulent coating material, a source of compressed gas, a nozzle coupled to the source of pulverulent material and providing an opening through which the pulverulent material is dispensed, and a deflector spaced from the opening to aid in shaping a cloud of dispensed coating material. The deflector includes at least one first passageway extending with a radial component of the deflector and communicating with the source of compressed gas to direct gas with a radial component into the cloud of dispensed coating material.

According to another aspect of the invention, a system for dispensing pulverulent coating material consists essentially of a source of pulverulent coating material, a source of compressed gas, a device for movably supporting a nozzle, the nozzle coupled to the source of pulverulent material and providing an opening through which the pulverulent material is dispensed, and a deflector supported by the device and spaced from the opening to aid in shaping a cloud of dispensed coating material. The deflector includes at least one first passageway extending with a radial component of the deflector and communicating with the source of compressed gas to direct gas with a radial component into the cloud of dispensed coating material.

According to another aspect of the invention, a system for dispensing pulverulent coating material consists essentially of a source of pulverulent coating material, a source of compressed gas, a nozzle coupled to the source of pulverulent material and providing an opening through which the pulverulent material is dispensed, a deflector spaced from the opening to aid in shaping a cloud of dispensed coating material, and a source of high-magnitude electrostatic potential coupled to impart electrostatic potential to the dispensed pulverulent material. The deflector includes at least one first passageway extending with a radial component of the deflector and communicating with the source of compressed gas to direct gas with a radial component into the cloud of dispensed coating material.

According to another aspect of the invention, a system for dispensing pulverulent coating material consists essentially of a source of pulverulent coating material, a source of compressed gas, a nozzle providing an opening through which the pulverulent material is dispensed, a device for movably supporting the nozzle, the nozzle coupled to the source of pulverulent material, a deflector supported by the device and spaced from the opening to aid in shaping a cloud of dispensed coating material, and a source of high-magnitude electrostatic potential coupled to impart electrostatic potential to the dispensed pulverulent material. The deflector includes at least one first passageway extending with a radial component of the deflector and communicating with the source of compressed gas to direct gas with a radial component into the cloud of dispensed coating material.

Illustratively, the at least one first passageway communicates with the source of compressed gas through a second passageway provided in the deflector.

Illustratively, the deflector includes a front surface and at least one first passageway is angled toward the front surface.

Additionally or alternatively illustratively, the deflector includes a front surface and at least one first passageway is angled away from the front surface.

Additionally or alternatively illustratively, the deflector includes a front surface and at least one first passageway extends parallel to the front surface.

Illustratively, the deflector includes a front surface and a second surface intersecting the front surface at a radially outer edge of the front surface. The front surface and second surface define between them an angle of less than 90°.

Illustratively, the deflector includes a front surface and a second surface intersecting the front surface at a radially outer edge of the front surface. The front surface and second surface define between them an angle of 90°.

Illustratively, the deflector includes a front surface and a second surface intersecting the front surface at a radially outer edge of the front surface. The front surface and second surface define between them an angle of greater than 90°.

Illustratively, the deflector includes a front surface and an axis about which the deflector is substantially symmetric. The front surface and axis define between them an angle of less than 90°.

Illustratively, the deflector includes a front surface and an axis about which the deflector is substantially symmetric. The front surface and axis define between them an angle of 90°.

Illustratively, the deflector includes a front surface and an axis about which the deflector is substantially symmetric. The front surface and axis define between them an angle of greater than 90°.

BRIEF DESCRIPTION OF THE DRAWINGS

The invention may best be understood by referring to the following detailed description and accompanying drawings which illustrate the invention. In the drawings.

DETAILED DESCRIPTIONS OF ILLUSTRATIVE EMBODIMENTS

Figure 1:
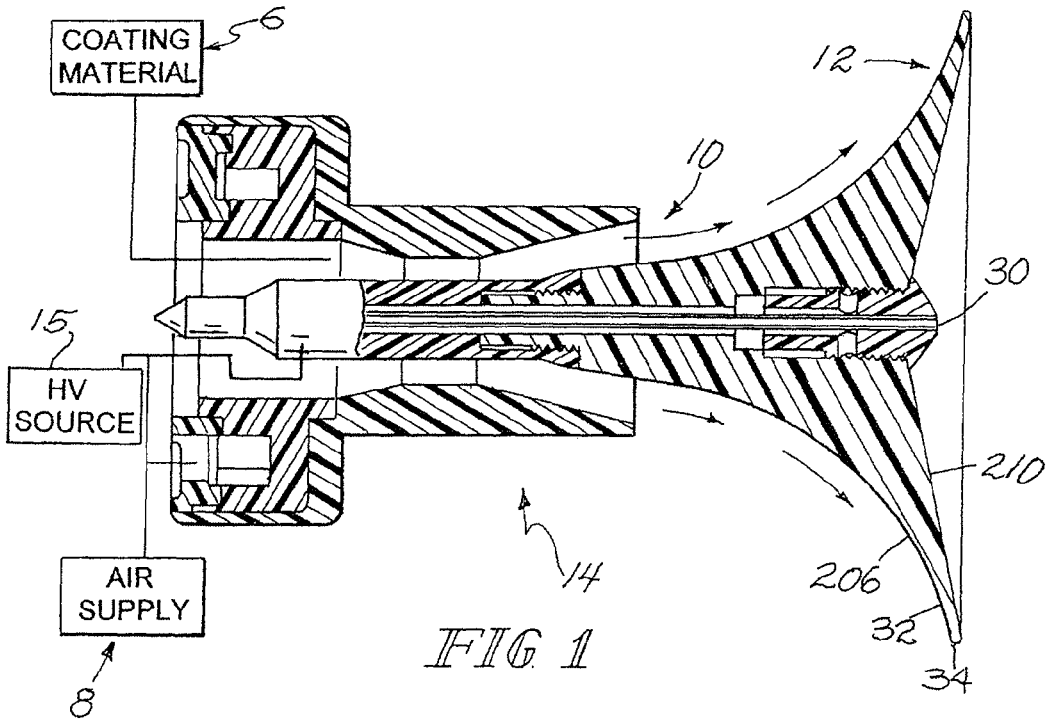
FIG. 1 illustrates a fragmentary longitudinal sectional side elevational view of the discharge end of a prior art powder gun.

Referring now to FIG. 1, a typical powder coating installation includes a powder source 6, a source 8 of compressed gas, and a powder gun 14 including a powder nozzle 10 and powder deflector 12. Powder gun may be automatic, as illustrated, or manual. The powder source 6 may be, for example, a fluidized bed of one of the general types illustrated and described in U.S. Pat. Nos. 5,240,185; 5,323,547; 5,335,828; and, 5,768,800. The source 8 of compressed gas may be, for example, compressed air from the coating installation (hereinafter sometimes factory air). The deflector 12 has a relatively large diameter to cause the dispensed powder to spread out, increasing the size of the spray pattern (hereinafter sometimes powder cloud or envelope) 16. In some such coating installations, a source 15 of high-magnitude electrostatic potential is coupled to (an) electrode(s) (not shown) mounted in the powder nozzle 10 and/or deflector 12 to charge the dispensed pulverulent material to increase its transfer efficiency, that is, the proportion of dispensed powder that actually ends up coating a target 36, all in accordance with known principles.

Figure 2:
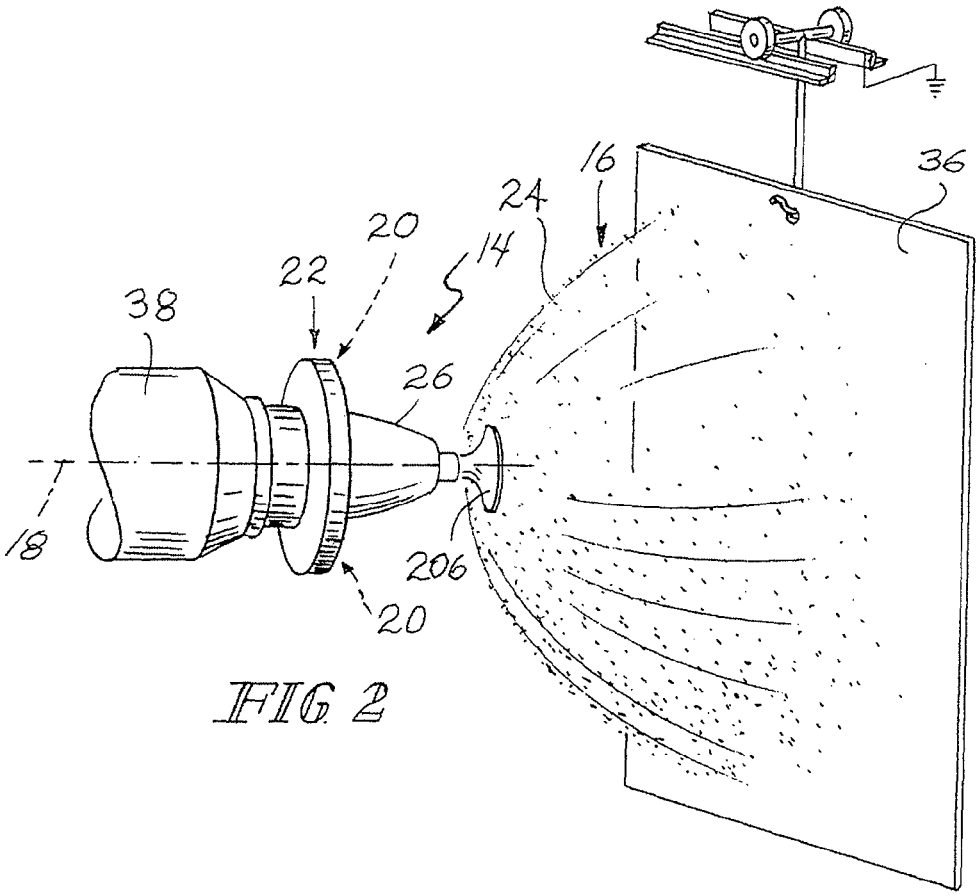
FIG. 2 illustrates a typical powder cloud achievable with a powder gun of the type illustrated in FIG. 1.

A typical powder cloud 16 is illustrated in FIG. 2. It is often desirable to reduce the size of the powder cloud 16, which might be thought of as somewhat of a paraboloid of revolution about a longitudinal axis 18 of the powder gun 14. To make the powder cloud 16 smaller (that is, to reduce the cross sectional areas of its sections transverse to axis 18), so-called "shaping air" is normally used. That is, factory air is passed through forwardly and radially outwardly facing openings 20 in a shaping air ring 22 toward the margin 24 of the powder cloud 16 in an effort to control the envelope of the powder cloud 16 to a smaller size. It has been discovered that the shaping air dispensed from the shaping air ring 22 tends to soil the shaping air ring 22, gun body 26 and nozzle 10 with dispensed powder. The higher the shaping air velocity, the dirtier the surfaces of the shaping air ring 22, gun body 26 and nozzle 10 tend to get.

Compressed air is also typically supplied through a center passageway 30 of the powder deflector 12. This is done because it tends to reduce the cross sectional areas of sections through the powder cloud 16 transverse to axis 18. See, for example, U.S. Pat. Nos. 4,381,079 and 4,447,008.

The prior art deflector 12 has a relatively thin wall thickness in the region 32 adjacent its radially outer, forward edge 34, which tends to make this wall more susceptible to damage. The shaping air ring 22 is necessary to control, for example, reduce the envelope of, the powder cloud 16. When higher shaping air velocities are required to reduce the size of the powder cloud 16 to smaller sizes, the higher shaping air velocities tend to reduce the transfer efficiency. Use of the shaping air ring 22 thus increases the cost associated with powder coating both by increasing the amount of factory air required to be maintained and by reducing the transfer efficiency of the equipment employing shaping air, thereby requiring a greater amount of powder to provide a coating of a predetermined thickness on the target 36. Additionally, where the powder gun 14 is mounted on a coating robot, reciprocator or like device 38 for manipulating powder gun 14, a shaping air ring 22 increases the weight borne by the device 38. This almost inevitably results in more frequent maintenance cycles for the device 38, further adversely affecting production costs.

Figure 5:
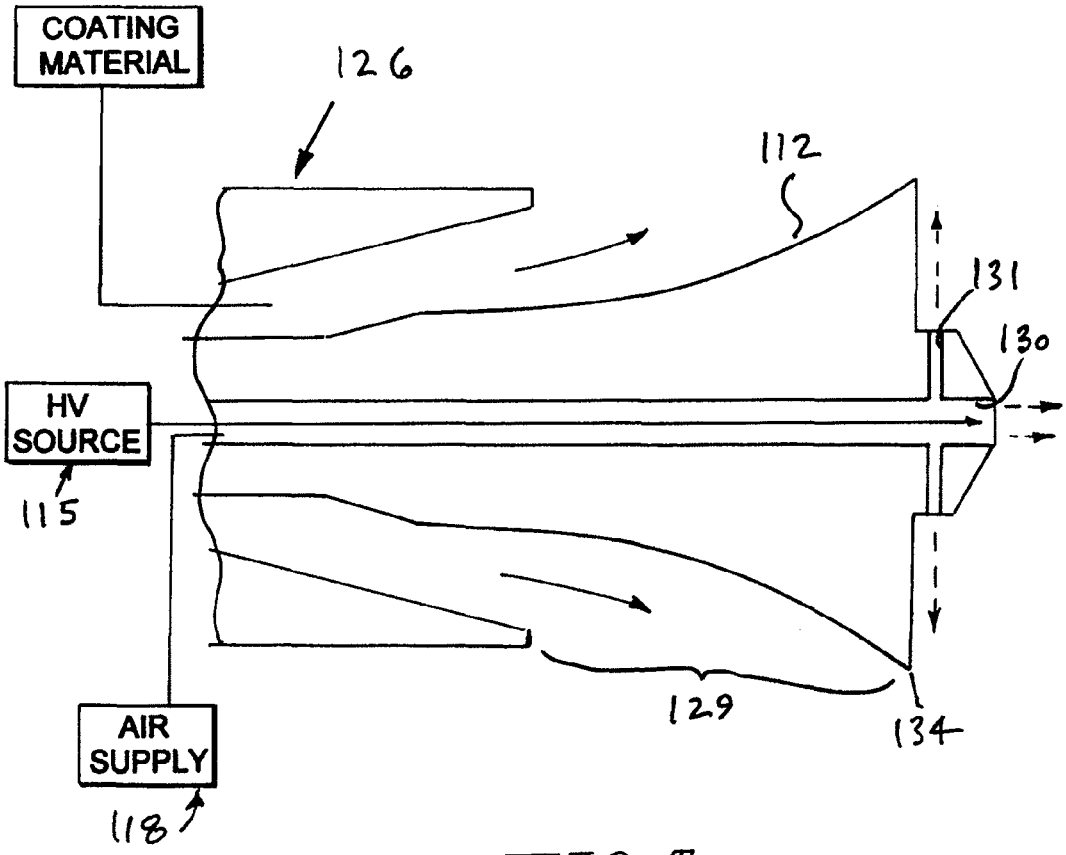
FIG. 5 illustrates a fragmentary longitudinal sectional side elevational view of the discharge end of a powder gun embodying the present invention.

FIG. 5 illustrates a deflector 112 according to the present invention. The deflector 112 has a smaller diameter than the prior art deflector 12, and provides radial air passageways 131 instead of, or in addition to, the prior art center air passageway 130. The annular gap 129 through which the powder is dispensed may be smaller than, the same as, or larger than in the prior art. Passageways 131 can be of circular, slot-shaped, or other suitable cross-sectional configuration.

Figure 6:
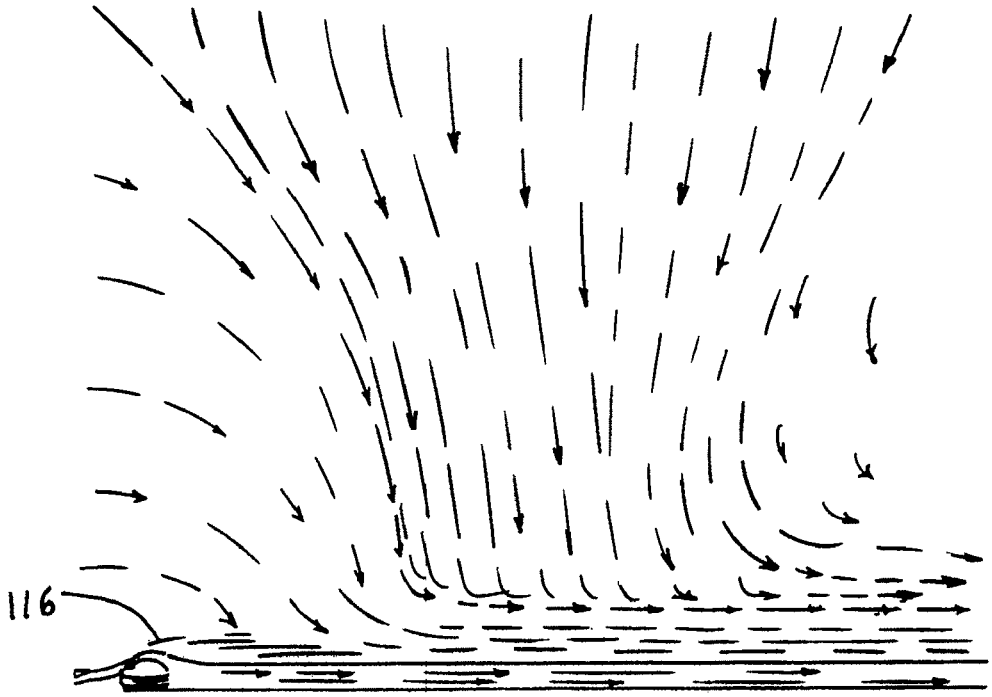
FIG. 6 illustrates flow vectors of powder discharged from a powder gun of the type illustrated in FIG. 5 under first conditions.
Figure 7:
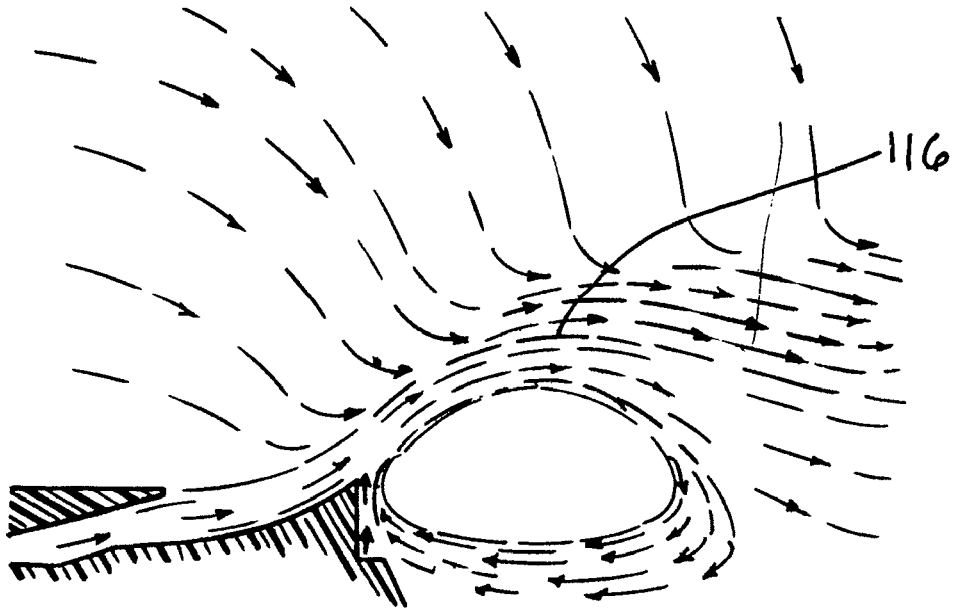
FIG. 7 illustrates an enlarged detail of the display illustrated in FIG. 6.
Figure 8:
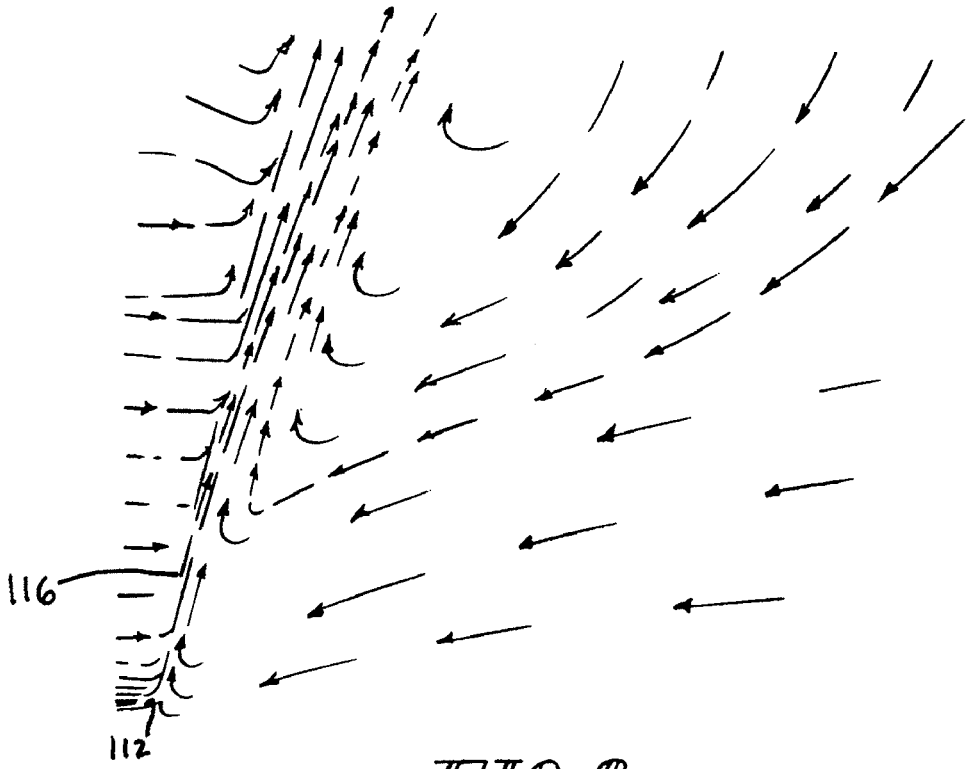
FIG. 8 illustrates flow vectors of powder discharged from a powder gun of the type illustrated in FIG. 5 under second conditions.
Figure 9:
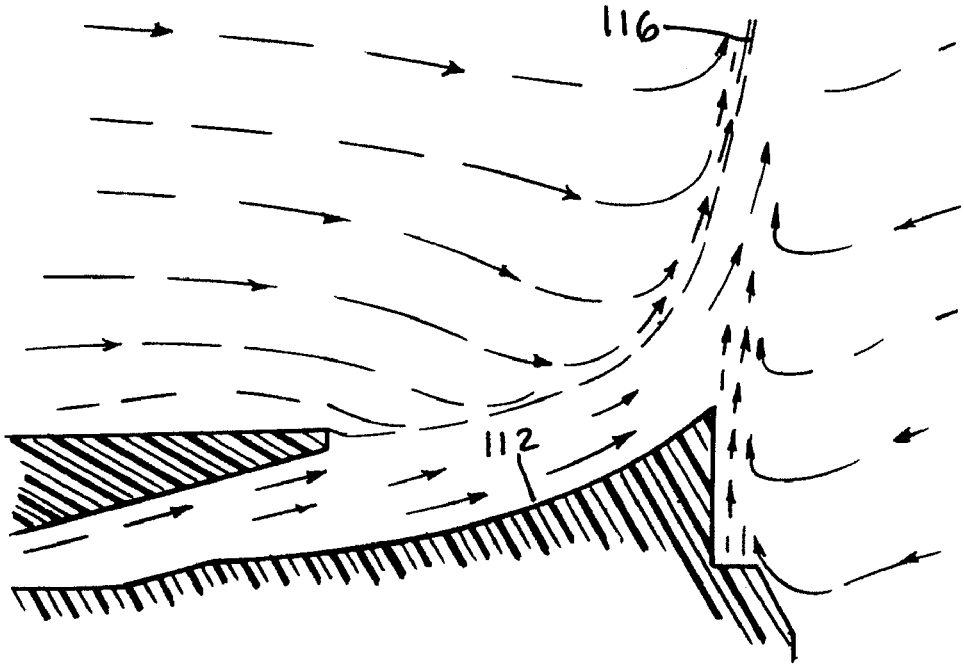
FIG. 9 illustrates an enlarged detail of the display illustrated in FIG. 8.

The performance of the deflector 112 of FIG. 5 was modeled using Computational Fluid Dynamics (CFD) simulations. FIG. 6 illustrates a larger scale diagram of air flow patterns around the deflector 112 when no air is being distributed through passageways 131. FIG. 7 illustrates a much enlarged view of a detail of the CFD pattern near the deflector 112. It can be seen from FIGS. 6-7 that the powder cloud 116 is smaller that was available with the prior art, even at relatively high shaping air consumption. When no radial air is applied through passageways 131 to the deflector 112 illustrated in FIG. 5, the powder cloud 116 is quite narrow. When radial air is applied through passageways 131 to the deflector 112 illustrated in FIG. 5, the powder cloud 116 can be increased to any desired size based upon the volume of air flow through passageways 131. This is illustrated in FIGS. 8 and 9.

Figure 3:
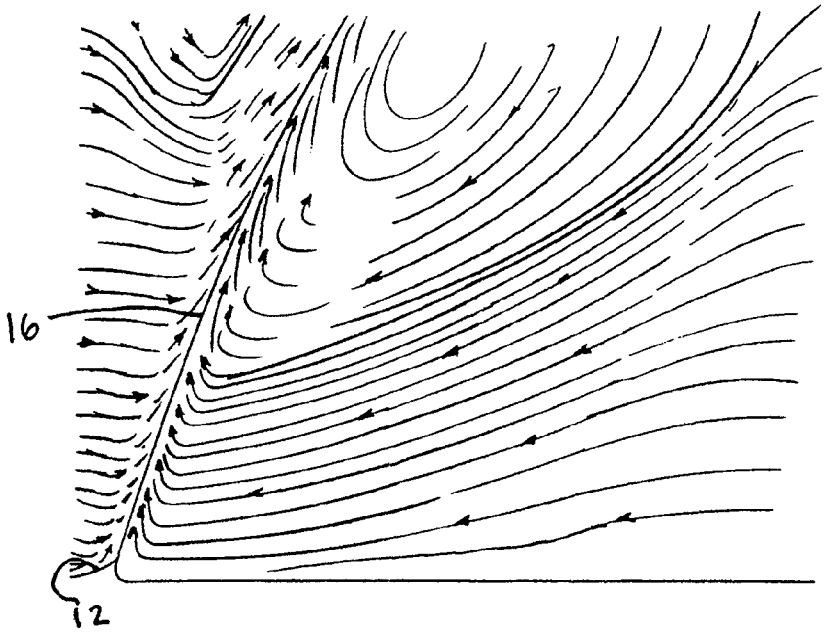
FIG. 3 illustrates flow vectors of powder discharged from a powder gun of the type illustrated in FIG. 1.
Figure 4:
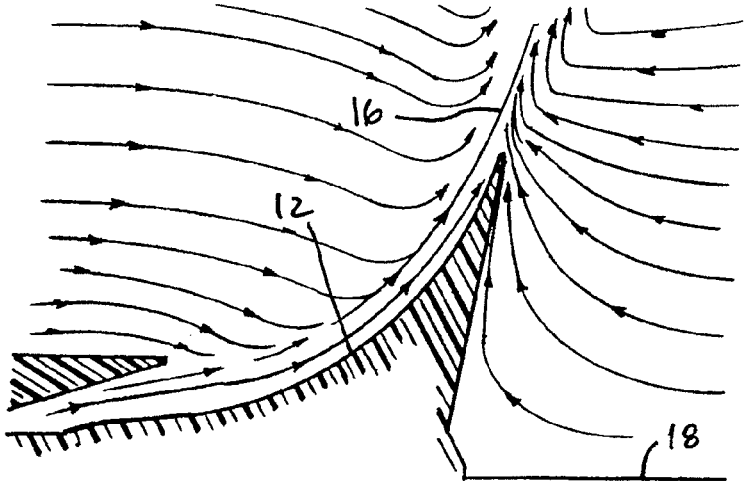
FIG. 4 illustrates an enlarged detail of the display illustrated in FIG. 3.

For comparison purposes, the air flow pattern of the prior art deflector 12 illustrated in FIG. 1 with no shaping air is simulated using CFD. FIGS. 3 and 4 illustrate the results. It can be seen by comparing FIGS. 3 and 4 to FIGS. 8 and 9 that the prior art gun 14 with a shaping air ring 22 and the gun with deflector 112 without a shaping air ring are capable of producing quite similar results, even though the gun with deflector 112 was operated without a shaping air ring 22. Prototypes constructed to test the deflector 112 illustrated in FIG. 5 confirmed that it performs as the CFD simulations predicted, displaying excellent powder cloud 116 control without a shaping air ring 22 and at least the above-discussed disadvantages associated with a shaping air ring 22. The relatively smaller deflector 112 with a relatively thicker wall section in the region 132 adjacent its forward edge 134 is more robust, less susceptible to damage. Powder cloud 116 control is achieved by controlling the airflow through passageways 131, without the prior art shaping air ring 22.

There are numerous other advantages which attend elimination of the shaping air ring 22. Less air is consumed since there is no shaping air ring 22 to which shaping air must be supplied. The gun body 126 remains cleaner, and the absence of a shaping air ring 22 removes concern about soiling such a shaping air ring 22. The absence of the shaping air ring 22 also improves the aesthetics of the gun body 126 design. The absence of the shaping air ring 22 and its need for higher velocity airflow when tighter (that is, smaller) powder patterns or powder cloud envelopes 16, 116 are required translates into higher transfer efficiency when such tighter, smaller patterns or powder cloud envelopes 16, 116 are used. Manufacturing cost is reduced because there is no shaping air ring 22. The absence of the shaping air ring 22 also results in less weight to be supported by a device 38, such as a robot arm in robotic coating material applications. The reduced surface area of the deflector 112 reduces impact area on the back side of the deflector 112, reducing the likelihood of impact fusion of dispensed powder on the back side of the deflector 112.

Figure 10:
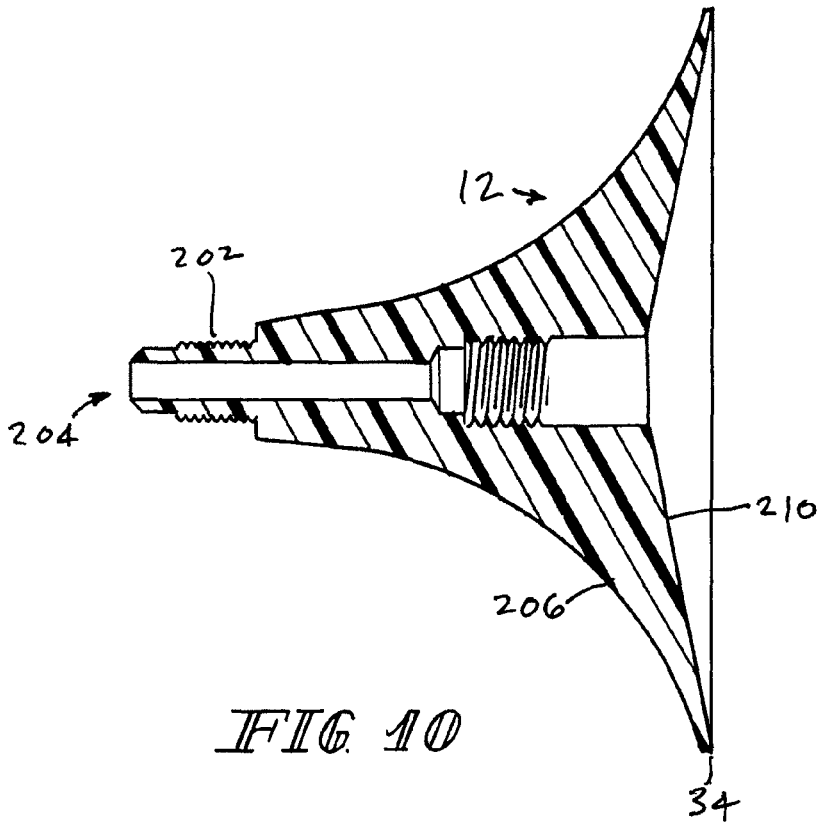
FIG. 10 illustrates an enlarged longitudinal sectional view of a detail of the powder gun illustrated in FIG. 1.

FIG. 10 illustrates an enlarged longitudinal sectional view of the deflector 12 of the powder gun 14 illustrated in FIG. 1. Deflector 12 is threaded 202 at its rearward end 204 to engage complementary threads, not shown, in the powder gun 14 to mount deflector 12 thereto. Deflector 12 extends forward from this mounting, providing an outwardly flaring surface 206 against which the powder dispensed through gun 14 impinges to cause the powder to spread into the powder cloud 16. Surface 206 terminates at forward edge 34 at which surface 206 intersects a concave, illustratively, generally frustoconically shaped, front surface 210 of deflector 12.

Figure 11:
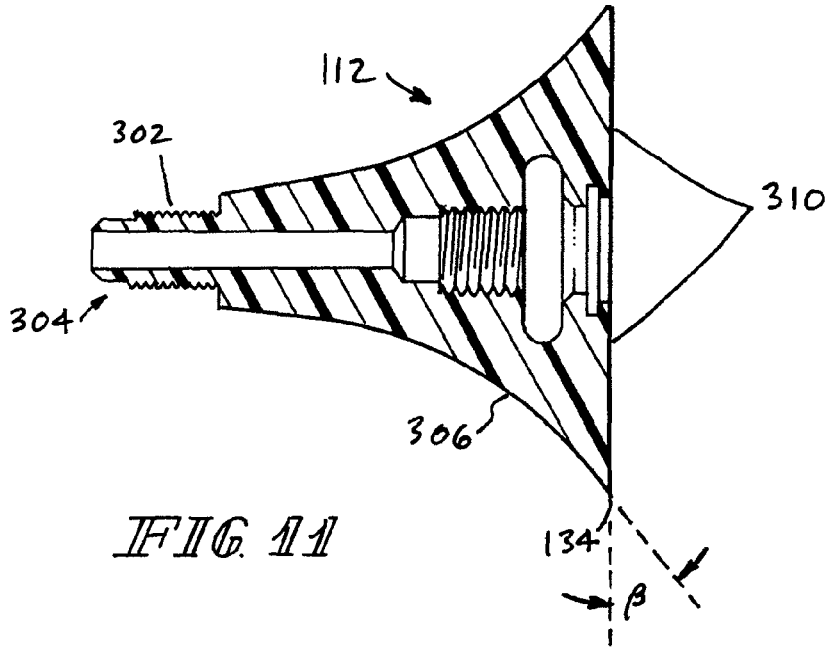
FIG. 11 illustrates an enlarged longitudinal sectional view of a detail of the powder gun illustrated in FIG. 5.

FIG. 11 illustrates an enlarged longitudinal sectional view of the deflector 112 of the powder gun 114 illustrated in FIG. 5, among others, for purposes of comparison to FIG. 10. Again, powder gun 114 may be automatic or manual. Deflector 112 is threaded 302 at its rearward end 304 to engage complementary threads, not shown, in the powder gun 114 to mount deflector 112 thereto. Deflector 112 extends forward from this mounting, providing an outwardly flaring surface 306 against which the powder dispensed through gun 114 impinges to cause the powder to spread into the powder cloud 116. Surface 306 terminates at forward edge 134 at which surface 306 intersects a flat front surface 310 of deflector 112. The included angles between surfaces 306, 310 and between surface 306 and axis 18 are not critical. The deflector 112 can be made using any suitable material, such as DuPont™ Tefzel® modified ethylene-tetrafluoroethylene fluoropolymer, Teflon® PTFE, or ultrahigh molecular weight polyethylene.

Figure 12:
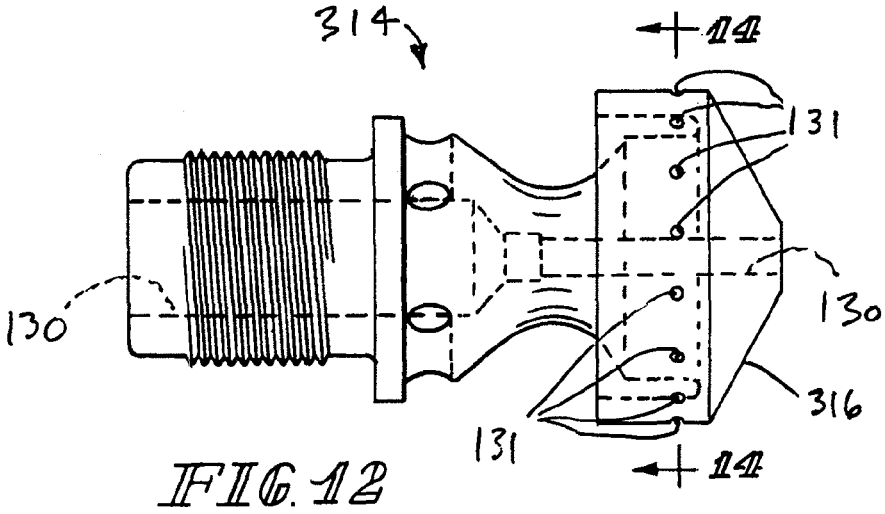
FIG. 12 illustrates an enlarged side elevational view of a detail of the powder gun illustrated in FIG. 5.
Figure 14:
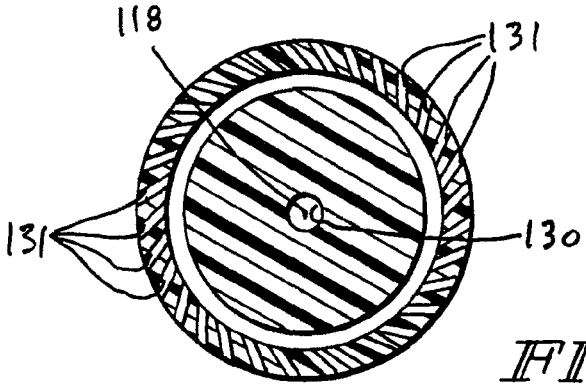
FIG. 14 illustrates a transverse sectional view of the detail illustrated in FIGS. 12-13, taken generally along section lines 14-14 of FIG. 12.
Figure 17:
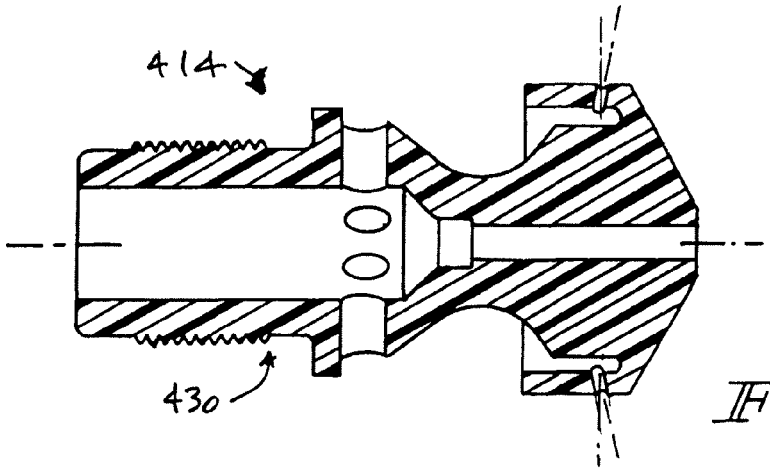
FIG. 17 illustrates a longitudinal sectional view of a modification of the detail illustrated in FIGS. 15-16.

FIG. 12 illustrates an enlarged longitudinal elevational view of a combination hub and electrode holder 314 for deflector 112. Hub/electrode holder 314 incorporates a portion of the length of center air passageway 130, as well as radial air passageways 131. Depending upon the configuration of an electrode (not shown) which is housed in center air passageway 130 and coupled, for example, through (a) suitable current limiting resistor(s) (not shown), to a power supply 115 (FIG. 5) in the case of an electrostatically aided application, air may be supplied to powder cloud 116 through radial air passageways 131 instead of, or in addition to, center air passageway 130. Hub/electrode holder 314 can be threaded, glued with a suitable glue, snap-fitted, or the like, into central passageway 130 in deflector 112. Passageways 131 need not extend exactly radially of hub/electrode holder 314, as best illustrated in FIGS. 14 and 17. In FIG. 14, passageways 131 are angled rearwardly, that is, in a direction opposite the direction of rotation of deflector 112. Alternatively, passageways 131 can be angled forwardly, in the direction of rotation of deflector 112. In FIG. 14, the angles are equal and are about 30° to radii through deflector 112, but other angles are useful as well. Additionally, it is contemplated that different, for example, alternate, passageways 131 may be angled different amounts as well. In the embodiment of FIG. 14, there are 32 passageways 131 circumferentially equally spaced 11.25° apart. Again, however, other numbers of passageways 131 equally and unequally spaced about the axis 118 of hub/electrode holder 314 are useful as well.

Figure 13:
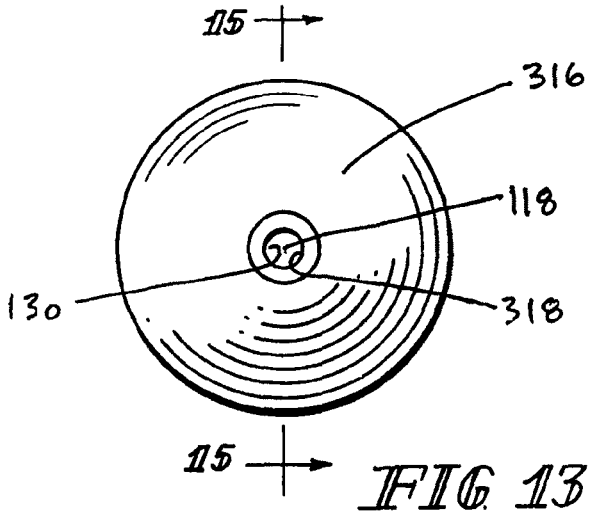
FIG. 13 illustrates a front elevational view of the detail illustrated in FIG. 12.

FIG. 13 illustrates the front, generally frustoconically shaped surface 316 of hub/electrode holder 314 illustrating a center opening 318 which may be the forwardmost end of passageway 130 in those embodiments in which there is no electrode in passageway 130 and those embodiments in which there is an electrode, but the configuration of the electrode permits air to pass forward through passageway 130 and out. In other embodiments, opening 318 may provide access to the forwardmost end of the electrode mounted in hub/electrode holder 314.

Figure 15:
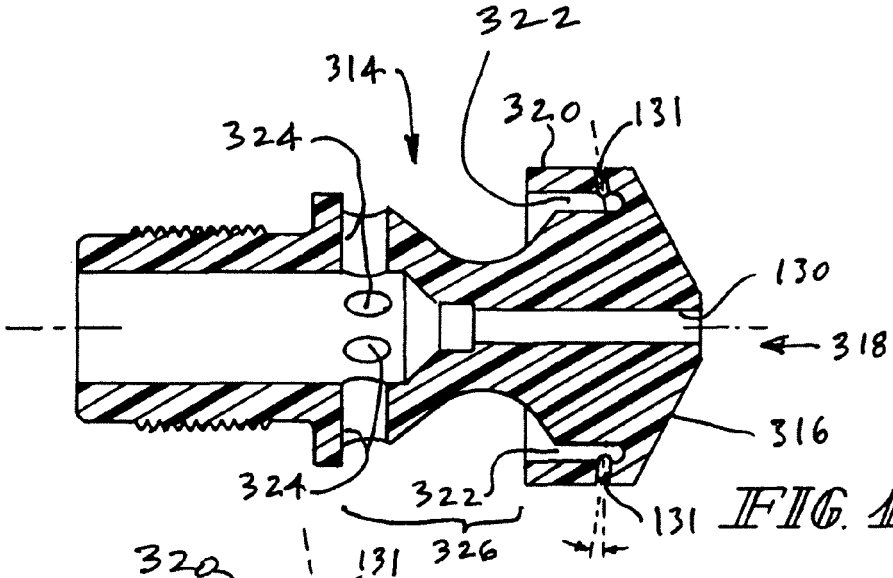
FIG. 15 illustrates a longitudinal sectional view of the detail illustrated in FIGS. 12-14, taken generally along section lines 15-15 of FIG. 13.
Figure 16:
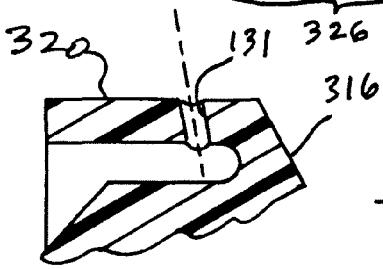
FIG. 16 illustrates a much enlarged detail of FIG. 15.

FIGS. 15 and 16 illustrate a longitudinal sectional view through hub/electrode holder 314 and a much enlarged detail showing how compressed air is provided to passageways 131 from a compressed air source 118 (FIG. 5). Hub/electrode holder 314 is inserted from surface 310 into the portion of passageway 130 in deflector 112 until a skirt 320 of hub/electrode holder 314 abuts surface 310 creating a gallery 322 behind frustoconical surface 316 and skirt 320 and in front of surface 310. Compressed air passes forward in passageway 130 exits through radial passageways 324 in hub/electrode holder 314, and then passes between the interior of the portion of passageway 130 in deflector 112 and a radially narrowed region 326 of hub/electrode holder 314 into gallery 322 and out through passageways 131 toward and along surface 310. To the extend the forwardmost end of passageway 130 in hub/electrode holder 314 is not plugged by any electrode residing therein, compressed air also flows forward and out the center hole 130 of hub/electrode holder 314 into the center of the powder cloud 116.

Figure 18:
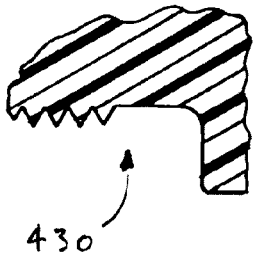
FIG. 18 illustrates a much enlarged detail of FIG. 17.

FIGS. 17 and 18 illustrate a longitudinal sectional view through another hub/electrode holder 414 and a much enlarged detail showing a configuration of a threaded region 430 at the rearward end of the hub/electrode holder 414. As previously mentioned, the passageways 131 need not extend perfectly radially of the hub/electrode holder 314, 414. As noted in the discussion of FIG. 3, passageways 131 may be angled forward or backward in the direction of rotation of deflector 112. Additionally, passageways may, as illustrated in FIG. 17, be angled backward toward surface 310, or may be parallel to surface 310, or may be angled forward away from surface 310. Again, the passageways 131 need not all be angled the same amount, or at all. In other words, adjacent passageways 131 may be angled backward toward surface 310, for example 2.5° from perpendicular to the axis of rotation of the assembled deflector 112/hub/electrode holder 414, not angled (that is, angled 0° from perpendicular to the axis of rotation of the assembled deflector 112/hub/electrode holder 414), and forward away from surface 310, for example, 2.5° from perpendicular to the axis of rotation of the assembled deflector 112/hub/electrode holder 414, not angled, and then restarting this sequence.

As previously noted, the prior art deflector 12 of FIGS. 1 and 10 has a relatively thin wall thickness in the region 32 adjacent its radially outer, forward edge 34, which tends to make this wall more susceptible to damage. The deflector 112 of FIGS. 5 and 11, on the other hand, has a relatively thicker wall section in the region 132 adjacent its forward edge 134 which is more robust and less susceptible to damage.

Figure 11A:
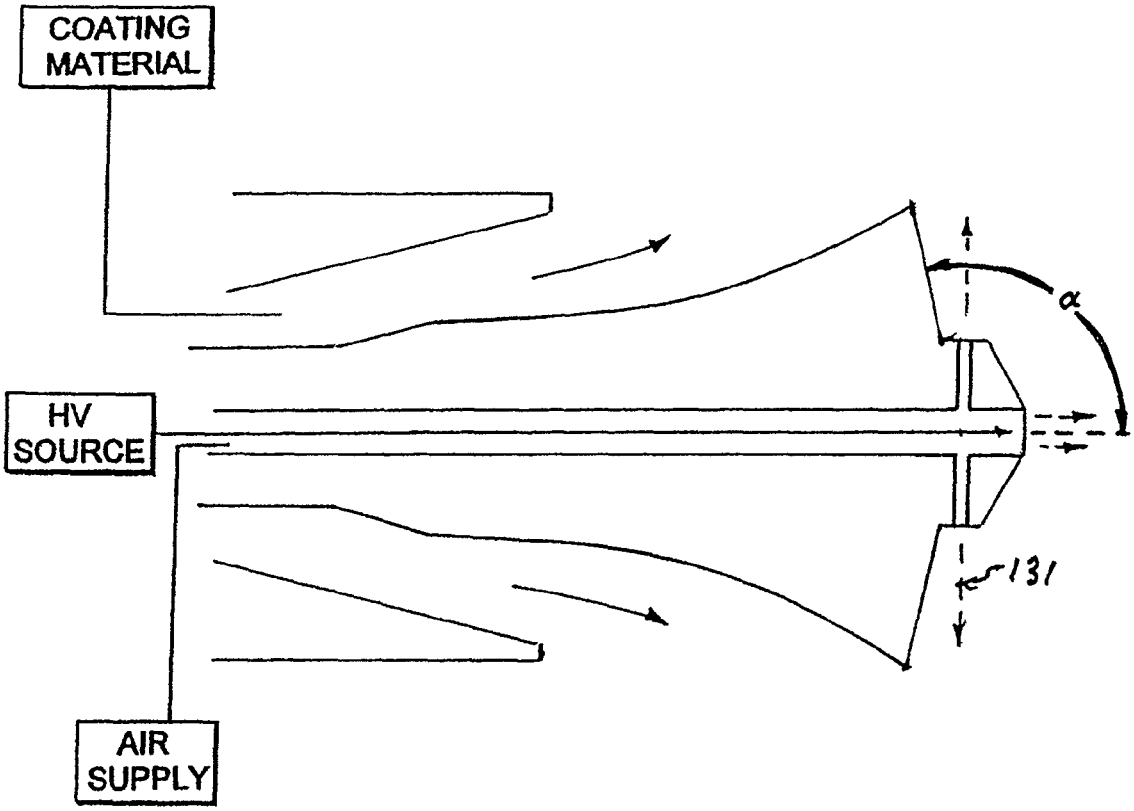
FIGS. 11*a-c* illustrate alternative construction details to certain construction details illustrated in FIG. 11.

Referring again to FIG. 11, the angle formed by the front flat surface 310 of deflector 112 and axis 18 is illustrated as 90°. Referring to FIG. 11*a*, this angle $\alpha$ can be greater than 90°. If the angle $\alpha$ is greater than 90°, the powder pattern can be made larger when radial air 131 is used. On the other hand, the power pattern can be made smaller if the angle $\alpha$ is less than 90°. The radial air jet angles can be parallel or hitting the surface 310. While having the air jets angled away from the surface 310 has not generally been found desirable, this embodiment too may have utility in certain applications.

Figure 11B:
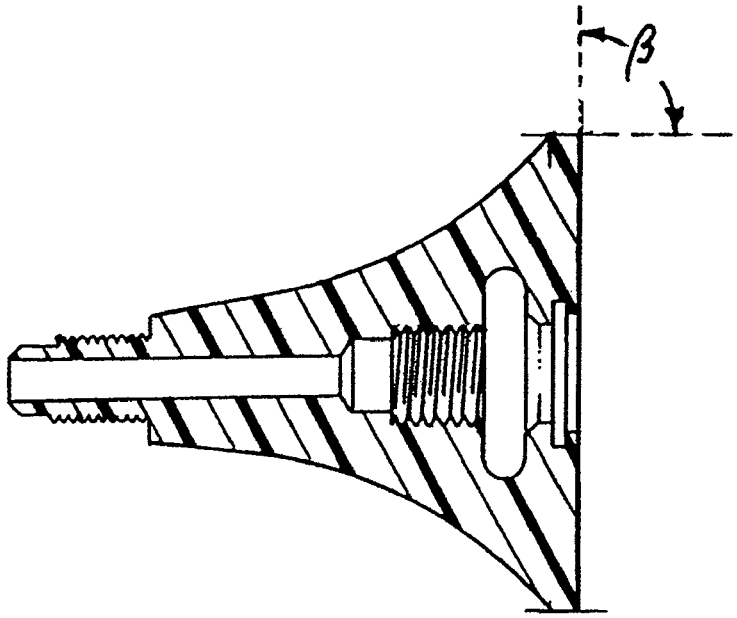
Figure 11C:
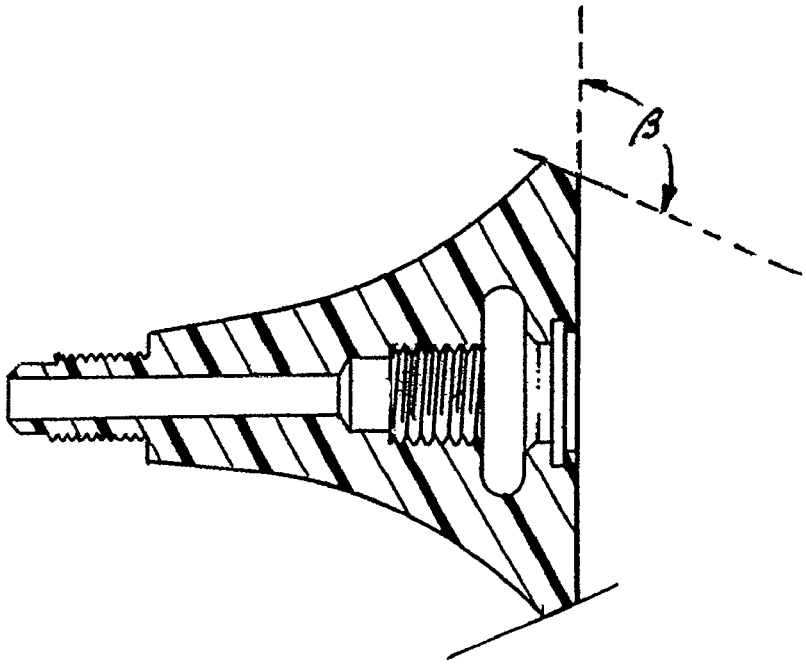

Referring again to FIG. 11, the angle $\beta$ formed between the tangents to surfaces 306 and 310 is less than 90°. However, this angle $\beta$ can be 90°, FIG. 11*b*, and larger than 90°, FIG. 11*c*. For the same radial air 131 flow conditions (for example, pressure, volume delivered per second, etc.), if the angle is 90° (FIG. 11*b*), the powder pattern will be smaller. If the angle is greater than 90° (FIG. 11*c*), the powder pattern will be smaller still.

Figure 19:
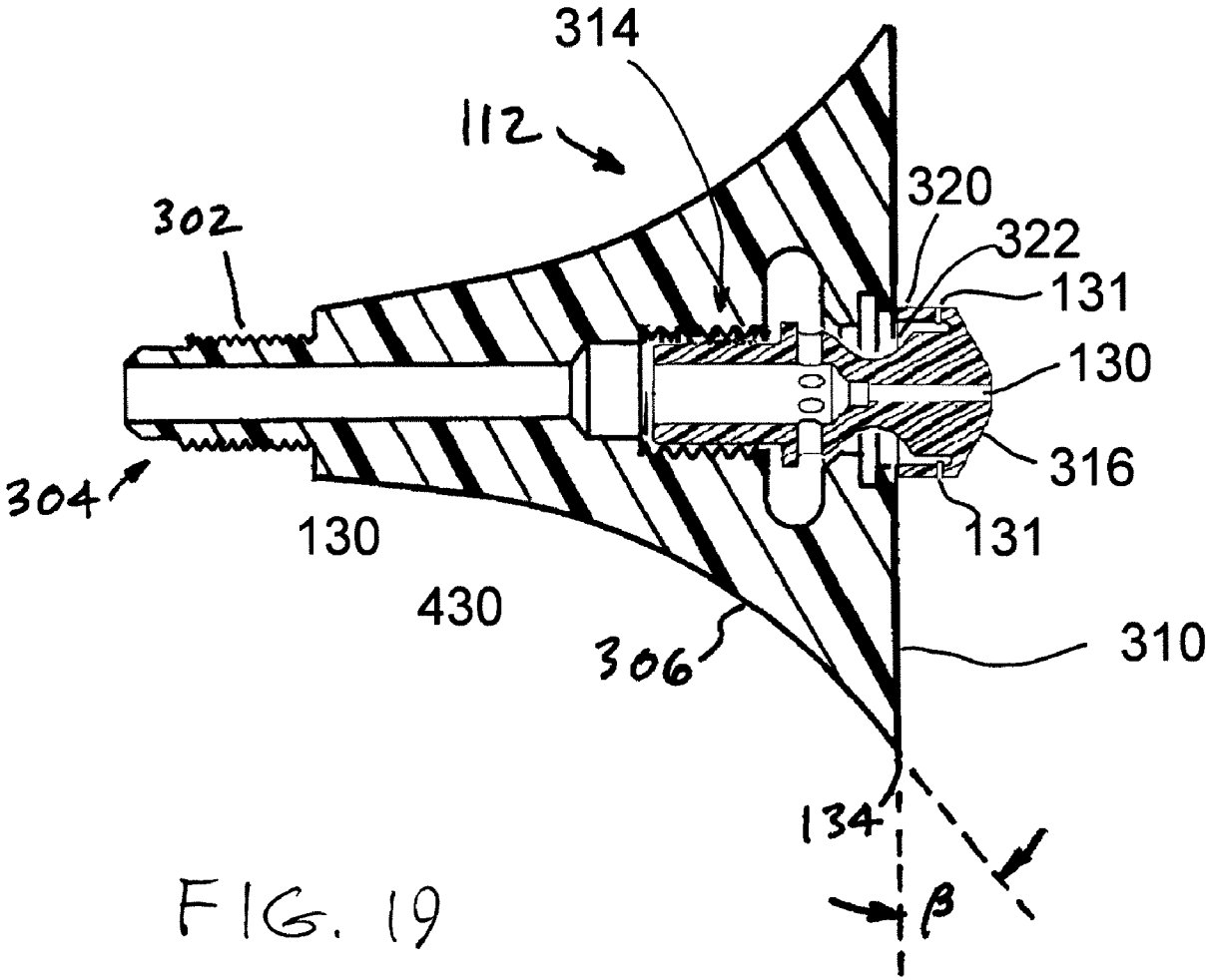
FIG. 19 illustrates a longitudinal sectional view of the detail illustrated in FIG. 12 as assembled with the detail illustrated in FIG. 11.

FIG. 19 illustrates the deflector 112 including first passageways 131 extending with a radial component of the deflector 112 and communicating with the source of compressed air to direct the compressed air with a radial component into the cloud 116 of dispensed coating material. The deflector 112 includes a flat front surface 310 located adjacent the forward-most end of the deflector 112 facing in the direction toward an article to be coated by the dispensed pulverulent coating material. The first passageways 131 extend parallel to the front surface 310. The hub 314 includes a front surface 316 and a skirt (like 320, FIG. 15) through which the passageways 131 extend. The hub 314 is mounted to the front surface 310 of the deflector 112 so that the skirt abuts the front surface 310 of the deflector 112 creating a gallery 322 behind the front surface 316 of the hub 314 and within the skirt. Compressed gas is supplied to the gallery 322. The first passageways 131 extend through the skirt from the gallery 322 to the exterior of the hub 314. The hub 314 includes a rearward threaded region (like threaded region 430, FIG. 17). The deflector 112 includes a complementarily threaded region (within air passageway 130) for receiving the threads of the rearward threaded region of the hub 314 to mount the hub 314 to the front surface 310 of the deflector 112.

What is claimed is:

1. A system for dispensing pulverulent coating material in a direction toward an article to be coated by the dispensed pulverulent coating material, the system consisting essentially of:

a source of pulverulent coating material;

a source of compressed gas;

a nozzle coupled to the source of pulverulent material, the nozzle providing an opening through which the pulverulent material is dispensed;

a source of high-magnitude electrostatic potential coupled to impart electrostatic potential to the dispensed pulverulent material;

a deflector spaced from the opening to aid in shaping a cloud of dispensed coating material, the deflector including a flat front surface facing in the direction toward an article to be coated by the dispensed pulverulent coating material;

a hub including a front surface and a skirt, the hub mounted to the front surface of the deflector so that the skirt abuts the front surface of the deflector creating a gallery behind the front surface of the hub and within the skirt, the gallery being in communication with the source of compressed gas, the hub including at least one first passageway extending with a radial component and communicating with the source of compressed gas, the at least one first passageway extending through the skirt from the gallery to the exterior of the hub parallel to the front surface of the deflector when the hub is mounted to the deflector, the hub including a rearward threaded section to mount the hub to a complementary threaded region of the deflector.

2. A system for dispensing pulverulent coating material in a direction toward an article to be coated by the dispensed pulverulent coating material, the system consisting essentially of:

a source of pulverulent coating material;

a source of compressed gas;

a device for movably supporting a nozzle, the nozzle coupled to the source of pulverulent material, the nozzle providing an opening through which the pulverulent material is dispensed;

the device further supporting a deflector spaced from the opening to aid in shaping a cloud of dispensed coating material, the deflector including a flat front surface facing in the direction toward an article to be coated by the dispensed pulverulent coating material;

a source of high-magnitude electrostatic potential coupled to impart electrostatic potential to the dispensed pulverulent material;

a hub including a front surface, a skirt, and at least one first passageway extending with a radial component communicating with the source of compressed gas to direct gas with a radial component into the cloud of dispensed coating material, the hub mounted to the front surface of the deflector so that the skirt abuts the front surface of the deflector creating a gallery behind the front surface of the hub and within the skirt, the at least one first passageway extending through the skirt from the gallery to the exterior of the hub parallel to the front surface of the deflector when the hub is mounted to the deflector, the hub including a rearward threaded section to mount the hub to a complementary threaded region of the deflector.

* * * * *